US011596511B2

(12) United States Patent
Morell Bras et al.

(10) Patent No.: US 11,596,511 B2
(45) Date of Patent: Mar. 7, 2023

(54) ARTIFICIAL INSEMINATION DEVICE FOR ANIMALS

(71) Applicant: TECNOVET, S.L.

(72) Inventors: Joan Morell Bras, Centelles (ES); Javier Gil Pascual, Centelles (ES)

(73) Assignee: TECNOVET, S.L., Barcelona (ES)

( * ) Notice: Subject to any disclaimer, the term of this patent is extended or adjusted under 35 U.S.C. 154(b) by 0 days.

(21) Appl. No.: 16/823,543

(22) Filed: Mar. 19, 2020

(65) Prior Publication Data

US 2020/0330209 A1 Oct. 22, 2020

(30) Foreign Application Priority Data

Apr. 17, 2019 (EP) ..... 19382305

(51) Int. Cl.
*A61D 19/02* (2006.01)

(52) U.S. Cl.
CPC ..... *A61D 19/028* (2013.01); *A61D 19/027* (2013.01)

(58) Field of Classification Search
CPC .... A61D 19/028; A61D 19/027; A61D 19/00; A61B 17/42; A61B 17/425; A61M 31/00
See application file for complete search history.

(56) References Cited

U.S. PATENT DOCUMENTS 6,423,038 B1 * 7/2002 Vancaillie ..... A61M 3/0279 604/279
6,706,026 B1 * 3/2004 Goldstein ..... A61M 31/00 604/278
2015/0297332 A1 10/2015 Schmitt et al.

FOREIGN PATENT DOCUMENTS

FR 2 668 054 A1 10/1990
FR 2 780 875 A1 7/1998
FR 2776505 A1 * 10/1999 ..... A61D 19/027
FR 2889052 A1 * 2/2007 ..... A61D 19/027
WO WO97/21396 6/1997
WO WO01/49205 7/2001

* cited by examiner

*Primary Examiner* — Kaylee R Wilson
(74) *Attorney, Agent, or Firm* — Gary J. Gershik

(57) ABSTRACT

The artificial insemination device for animals comprises a cannula (1); an insertion tip (2) placed on one of the ends of the catheter (1), said insertion tip (2) having one or more holes (7); and a fixing element (3) placed on a cannula (1), wherein said fixing element (3) comprises a tubular portion (8), a first frustoconical portion (4) and a second frustoconical portion (5). The artificial insemination device for animals according to the present invention enables, by not disturbing or hyperstimulating the animal, the cannula to reach the uterus and be fixed in the correct position in order to suitably perform post-cervical insemination in young sows.

11 Claims, 1 Drawing Sheet

ARTIFICIAL INSEMINATION DEVICE FOR ANIMALS

RELATED APPLICATIONS

This application claims priority of European Patent Application No. 19 382 305.1, filed Apr. 17, 2019, the entire contents of which are hereby incorporated by reference into this application.

DESCRIPTION

The present invention relates to an artificial insemination device for animals, which enables fixing in position without disturbing the animal.

BACKGROUND OF THE INVENTION

The application of a seminal dosage in animals in oestrus, in particular in sows, is routinely performed vaginally, being used as an instrument called a catheter in the shape of a tube which, despite possibly having different shapes, is used in all cases to reach the cervix of the uterus and be fixed in the first centimetres thereof, enabling the application of the seminal dosage therethrough, which must pass through the rest of the cervix until reaching the body of the uterus.

There are currently different types of catheters which range from the classic reusable catheter manufactured in a single rubber part or similar, to a nearly endless list of plastic single-use catheters.

The latter are generally made up of three parts which correspond to the handle, the shaft and the end or tip, such that handle, not present in all catheters, is a small part that is used to handle the catheter easily and, in those that have it, it is used to fix the cannula of the seminal container to the catheter.

The shaft or body of the catheter is a tube that is approximately 50 centimetres long, which is used to allow passage of the seminal fluid, the diameter of said tube being variable, but in no case does the outside dimension exceed 10 millimetres.

The tip, as a main element of the catheter, is a part with a varying size and shape, which in any case makes the insertion and fixing thereof in the cervix of the uterus possible. There are those with a cylindrical shape (plug), for example, manufactured from foam, and there are those with a conical shape, manufactured from different types of plastics and with sizes that vary widely.

Regardless of the shape thereof, the tip must ensure a sufficient level of fixing in the cervix to avoid problems at the time the semen is deposited.

For this reason, the use of fixing elements placed on the catheter is common. In these cases, the fastening to the cervix of the uterus is normally facilitated thanks to the shape of said fixing elements, which increase the level of coupling between the catheter and the irregularities of the cervical wall. However, the presence of these fixing elements can disturb or hyperstimulate the animal, which can have an effect on insemination.

An example of this type of insemination device is described in document WO 2001/049205 A1. This document describes an artificial insemination device comprising a catheter provided with a tip and a helical fixing element placed on said catheter.

Apart from traditional insemination, a technique usually used in replacement sows, wherein the semen is deposited in the cervix through a catheter, the technique of post-cervical insemination is routinely used today in sows that have already given birth, wherein the semen is deposited in the body of the cervix and for which an instrument made up of a guide catheter and a post-cervical cannula is used.

The guide catheter is fixed to the cervix like in traditional insemination and the much thinner cannula that runs through the inside thereof passes through the cervix of the uterus until reaching the body of the cervix, wherein the semen is deposited, which enables a much smaller amount of semen to be used and the insemination is performed much more accurately and in much less time.

This type of insemination is not regularly used in replacement sows, since the hyperstimulation associated with the discomfort caused by the guide catheter causes a contraction of the cervix muscles that is maintained for many minutes, which closes the cervical canal preventing further movement of the post-cervical cannula and therefore preventing insemination in the body of the uterus.

This problem does not occur in postpartum pigs, even though it does arise in some of those who have given birth more than once, since like the replacement sows, the hyperstimulation associated with the discomfort is a consequence of the lack of prior experience and of the smaller size of the genital apparatus of younger sows.

Therefore, an objective of the present invention is to provide an artificial insemination device for sows, which is able to reach the body of the uterus and remain fixed in position, but does not disturb or hyperstimulate the animal, allowing for post-cervical insemination in young sows.

DESCRIPTION OF THE INVENTION

The artificial insemination device for animals of the invention resolves the drawbacks mentioned and has other advantages which are described below.

The artificial insemination device for animals according to the present invention comprises;

a cannula, an insertion tip placed on one of the ends of the cannula, said tip having one or more holes; and a fixing element placed on the cannula;

wherein said fixing element comprises a tubular portion, a first frustoconical portion and a second frustoconical portion.

Advantageously, said first and second frustoconical portions are made from a sufficiently flexible material that significantly reduces discomfort, and therefore hyperstimulation, in comparison with that produced by the guide catheter normally used in post-cervical insemination.

Moreover, due to being a flexible material, said first and second frustoconical portions define an end with a larger diameter and an end with a smaller diameter, such that during the insertion of the cannula; said ends with a larger diameter are farther from the insertion tip, and during the removal of the cannula; said ends with a larger diameter are closer to the insertion tip.

Said cannula also preferably comprises an indication of insertion, for example, a plurality of lines, to indicate the correct insertion depth that suggests that the uterus has been reached.

According to a preferred embodiment, the diameter of the end with a larger diameter of the first frustoconical portion is smaller than the diameter of the end with a larger diameter of the second frustoconical portion.

Moreover, preferably, said first frustoconical portion is arranged closer to the tip than said second frustoconical portion.

Thanks to the configuration of the fixing element with two frustoconical portions, the desired fixing operation is performed without disturbing the animal; which prevents sustained muscle contraction and enables the cannula to pass to the body of the uterus without difficulty.

Furthermore, thanks to the flexible nature of said frustoconical portions, said portions change their orientation based on whether the cannula is being inserted or removed, without disturbing the animal.

BRIEF DESCRIPTION OF THE DRAWINGS

To better understand what has been set forth above, several drawings schematically depicting a practical embodiment only by way of non-limiting example are attached.

DESCRIPTION OF A PREFERRED EMBODIMENT

Figure 1:
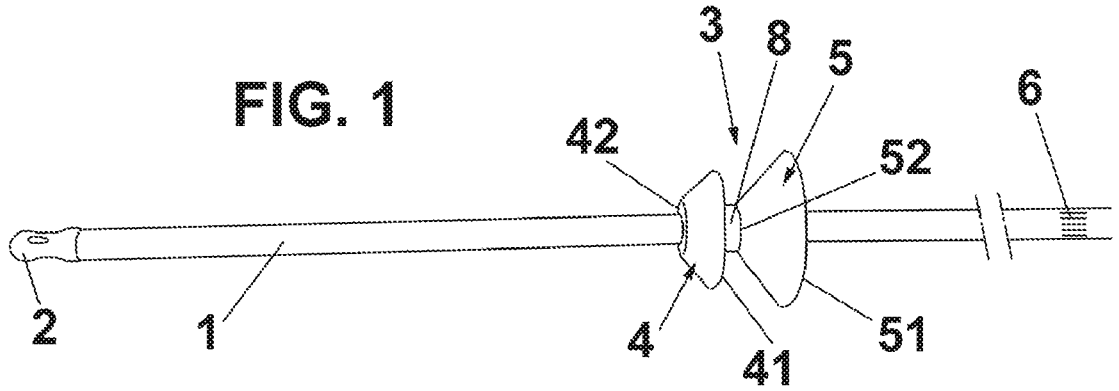
FIG. 1 is a perspective view of the artificial insemination device according to the present invention in the insertion position thereof.
Figure 2:
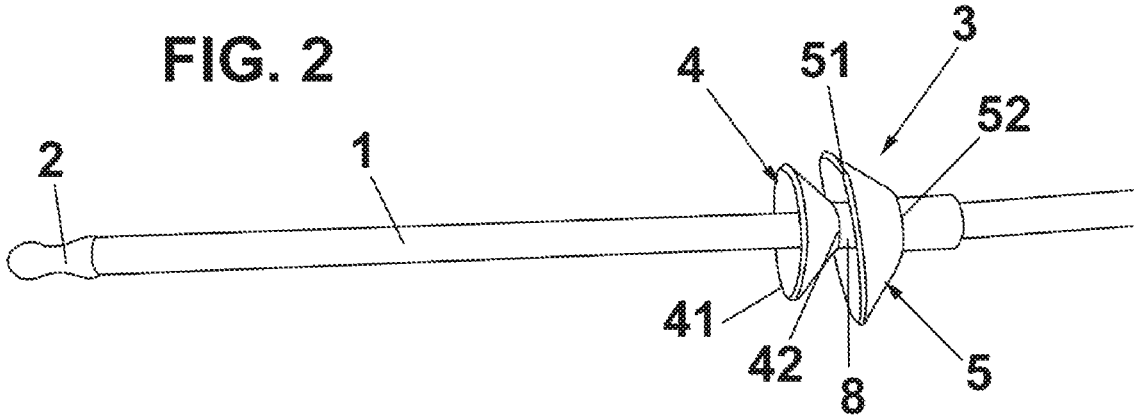
FIG. 2 is a perspective view of the artificial insemination device according to the present invention in the removal position thereof.

As shown in FIGS. 1 and 2, the artificial insemination device for animals according to the present invention comprises a cannula 1, which is a tubular element that is inserted in the cervix of the animal to be inseminated.

To facilitate the insertion thereof, said cannula 1 comprises on one of the ends thereof an insertion tip 2 comprising one or more holes 7 to enable the semen to exit therethrough to inseminate the animal.

To enable fixing of the cannula 1 in position during insemination, the insemination device further comprises a fixing element 3 placed on said cannula in a portion thereof.

Said fixing element 3 comprises a first frustoconical portion 4 and a second frustoconical portion 5, both frustoconical portions 4, 5 being placed in a tubular portion 8 which is that which surrounds said cannula 1 in a fitted manner.

Said frustoconical portions 4 and 5 are made from a flexible material, such that they vary their orientation based on the direction of movement of the cannula 1 and it also enables the insertion and removal of the cannula without disturbing the animal.

Said first and second frustoconical portions 4, 5 each comprise an end with a larger diameter 41, 51 and an end with a smaller diameter 42, 52 and the diameter of the end with a larger diameter 41 of the first frustoconical portion 4 is smaller than the diameter of the end with a larger diameter 51 of the second frustoconical portion 5.

Moreover, the first frustoconical portion 4 is placed closer to the insertion tip 2 than the second frustoconical portion 5.

When the cannula 1 is inserted, said first and second frustoconical portions 4, 5 are oriented as shown in FIG. 1, i.e. with the ends with a smaller diameter 42, 52 closer to the insertion tip 2 than the ends with a larger diameter 41, 51.

On the other hand, when the cannula 1 is removed, the orientation of said first and second frustoconical portions 4, 5 changes thanks to the flexible nature of the material. In other words, during the removal of the cannula, the ends with a larger diameter 41, 51 are closer to the insertion tip 2 than the ends with a smaller diameter 42, 52.

To facilitate the correct placement of the cannula 1, said cannula comprises an indication of insertion 6, shown in FIG. 1, for example, indication lines, which indicate the correct position of the cannula 1 in the insemination position, with a margin of error of, for example, 2-3 cm.

Despite the fact that reference has been made to a specific embodiment of the invention, it is evident for the person skilled in the art that numerous variations and changes may be made to the artificial insemination device for animals described, and that all the aforementioned details may be substituted by other technically equivalent ones, without detracting from the scope of protection defined by the attached claims.

The invention claimed is:

1. An artificial insemination device for animals, comprising:

a cannula;

an insertion tip placed on one of the ends of the cannula, said insertion tip having one or more holes; and a fixing element placed on the cannula, wherein said fixing element comprises a tubular portion, a first frustoconical portion and a second frustoconical portion, the first frustoconical portion is closer than the second frustoconical portion, to the insertion tip, and the first frustoconical portion is smaller than the second frustoconical portion;

wherein the fixing element is disposed to be offset by a distance from the insertion tip, the distance being larger than a distance between the first frustoconical portion and the second frustoconical portion to permit the fixing element to fix the cannula in position inside a body of a uterus of a subject animal after the insertion tip is inserted into the body of the uterus.

2. The artificial insemination device for animals according to claim 1, wherein said first and second frustoconical portions are made from a flexible material.

3. The artificial insemination device for animals according to claim 2, wherein each of said first and second frustoconical portions has a larger diameter end and a smaller diameter end, such that in a first orientation during insertion of the cannula, the larger diameter end is farther than the smaller diameter end from the insertion tip and in a second orientation during removal of the cannula, the larger diameter end is closer than the smaller diameter end to the insertion tip.

4. The artificial insemination device for animals according to claim 3, wherein the larger diameter end of the first frustoconical portion is smaller than the larger diameter end of the second frustoconical portion.

5. The artificial insemination device for animals according to claim 1, wherein said cannula comprises an indication of insertion.

6. An artificial insemination device for animals, comprising:

a cannula;

an insertion tip disposed on an end of the cannula, said insertion tip having one or more holes; and a fixing element disposed on the cannula, said fixing element comprising a tubular portion, a first frustoconical portion and a second frustoconical portion, wherein the first frustoconical portion is closer than the second frustoconical portion to the insertion tip, the first frustoconical portion is smaller than the second frustoconical portion, each of the first and second frustoconical portions includes a larger diameter end and a smaller diameter end and is configured to fix the cannula in position during insemination, and wherein a diameter of the larger diameter end of the second frustoconical portion is larger than a diameter of the larger diameter end of the first frustoconical portion;

wherein the fixing element is disposed to be offset by a distance from the insertion tip, the distance being larger than a distance between the first frustoconical portion and the second frustoconical portion.

7. The artificial insemination device according to claim 6, wherein said first and second frustoconical portions are made from a flexible material to permit each of the first and second frustoconical portions to have a first orientation during insertion of the cannula in which the larger diameter end is farther than the smaller diameter end from the insertion tip, and to have a second orientation during removal of the cannula in which the larger diameter end is closer than the smaller diameter end to the insertion tip, as well as permitting each of the first and second frustoconical portions to fix the cannula in position during insemination without disturbing the animal.

8. The artificial insemination device according to claim 6, wherein said cannula comprises an indication of insertion.

9. An artificial insemination device for animals, comprising:

a cannula to be inserted in a cervix of an animal to be inseminated;

an insertion tip placed on one of the ends of the cannula, said insertion tip having one or more holes; and a fixing element placed on the cannula, said fixing element comprising a tubular portion, a first frustoconical portion and a second frustoconical portion, wherein the first frustoconical portion is closer than the second frustoconical portion to the insertion tip, the first frustoconical portion is smaller than the second frustoconical portion, and each of said first frustoconical portion and second frustoconical portion is made from a flexible material and is configured to fix the cannula in position during insemination, and each of said first frustoconical portion and second frustoconical portion includes an end with a larger diameter and an end with a smaller diameter;

wherein the fixing element is disposed to be offset by a distance from the insertion tip, the distance being larger than a distance between the first frustoconical portion and the second frustoconical portion, and wherein in a first orientation during insertion of the cannula said ends with a larger diameter are farther from the insertion tip, and in a second orientation during removal of the cannula said ends with a larger diameter are closer to the insertion tip.

10. The artificial insemination device according to claim 9, wherein said cannula comprises an indication of insertion.

11. The artificial insemination device according to claim 9, wherein the larger diameter end of the first frustoconical portion is smaller than the larger diameter end of the second frustoconical portion.

* * * * *